US006203335B1

(12) United States Patent
Chang

(10) Patent No.: US 6,203,335 B1
(45) Date of Patent: Mar. 20, 2001

(54) MOBILE PHONE CONNECTOR AND THE ART OF ASSEMBLY OF CONTACTS AND A HOUSING

(75) Inventor: Yao-Hao Chang, Chung-Ho (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/471,535

(22) Filed: Dec. 22, 1999

(51) Int. Cl.[7] ..... H01R 12/00
(52) U.S. Cl. ..... 439/79; 439/289
(58) Field of Search ..... 439/63, 79, 289

(56) References Cited

U.S. PATENT DOCUMENTS

| | | | | |
|---|---|---|---|---|
| 5,281,165 | * | 1/1994 | McCleerey et al. | 439/510 |
| 5,689,405 | * | 11/1997 | Bethurum | 361/737 |
| 5,822,855 | * | 10/1998 | Szczesny et al. | 29/883 |
| 5,865,648 | * | 2/1999 | Clyatt, III | 439/620 |
| 5,980,272 | * | 11/1999 | McHugh et al. | 439/79 |
| 6,062,875 | * | 5/2000 | Konno et al. | 439/74 |

* cited by examiner

*Primary Examiner*—Neil Abrams
*Assistant Examiner*—Michael C. Zarroli
(74) *Attorney, Agent, or Firm*—Wei Te Chung

(57) ABSTRACT

An electrical connector comprises a plurality of contacts, an insulative housing and a shell. The insulative housing comprises a first receptacle portion and a second receptacle portion respectively defining first and second receiving passageways therethrough. A plurality of positioning apertures is defined in a top wall of the housing in communication with corresponding receiving passageways. The contacts are insert molded into the housing so that the dimension of the pitch distance between neighboring contacts is small, thus decreasing the dimension of the connector. The contacts include signal contacts and DC power contacts respectively received in the first and the second receiving passageways of the first and the second receptacle portions. All contacts are identical, each having a vertical section received in a mating portion of a corresponding receiving passageway and extending upwardly into the corresponding positioning aperture, and a horizontal section received in the receiving passage and having a solder tail exposed out of the housing. The shell encloses the housing and has a locking aperture on a bottom plate thereof under each positioning slot of the housing. The contacts are fixed in the housing through the positioning apertures in manufacturing.

10 Claims, 6 Drawing Sheets

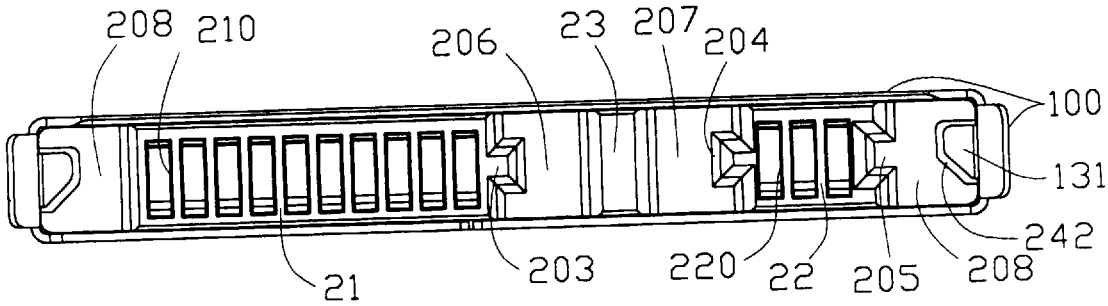
FIG. 3
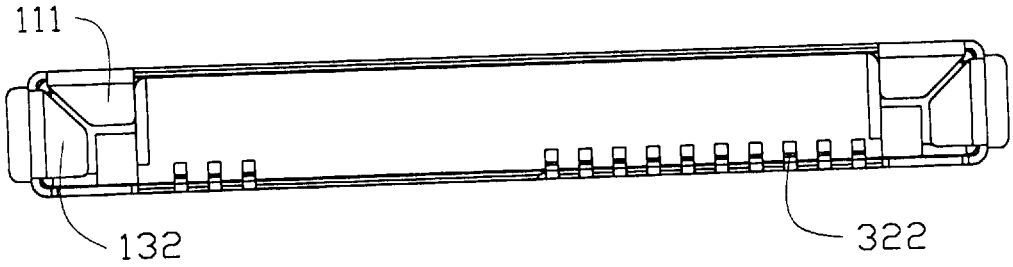
FGI. 4

MOBILE PHONE CONNECTOR AND THE ART OF ASSEMBLY OF CONTACTS AND A HOUSING

BACKGROUND OF THE INVENTION

1. Field of the Invention

The present invention relates to an electrical connector, and particularly to a composite connector having small dimensions used in a mobile phone for alternative connection with mating connectors in order to transmit signals or DC power from a charge.

2. Description of Prior Art

With developments in the communications industry, the functions and use of portable phones are improving day by day. Accordingly, connectors used in portable phones are developing rapidly. The trend today is to integrate many functions and produce units having smaller dimensions for facilitating consumer carrying. U.S. Pat. No. 5,812,660 discloses a prior art connector shown in FIG. 7. The prior art connector comprises an insulative housing 6 having a rectangular connection recess 611 extending rearward from a front surface 61. A flat connector 612 and a pair of RF terminals 613 are arranged within the connection recess 611. The flat connector 612 includes an insulation plate 612 and signal terminals 7 on upper and lower surfaces of the insulation plate. The RF terminals 613 are disposed on opposite sides of the flat connector. A pair of metallic reinforcing members 614 is provided on opposite sides of the connection recess 611 not only to reinforce the thin upper wall of the connection recess but also to serve as power terminals for recharging by means of a charger. The connector is also provided with a DC jack 615, which is accessible from the front surface 61. Battery terminals 8 project diagonally upward through the upper left sidewall of the housing 6 for contact with a battery within the portable phone. An integrated mating connector is required to mate the plate connector 612 and the RF terminals 613 and it is impossible to use two small size and optional use connectors in the prior art. In addition, when the battery is charged with a charge the flat connector and the RF terminals do not work at the same time, so do not facilitate use by the consumer. Hence, an improved electrical connector is required to overcome the disadvantages of the prior art.

SUMMARY OF THE INVENTION

A first object of the present invention is to provide a mobile phone connector, which has many functions assembled therein.

A second object of the present invention is to provide a mobile phone connector, which can alternatively connect with mating connectors in order to transmit signal or DC power.

A third object of the present invention is to provide a mobile phone connector which has small dimensions for facilitating consumer carrying.

An electrical connector of the present invention comprises a plurality of contacts, an insulative housing and a shell. The insulative housing comprises a first receptacle portion defining first receiving passageways therethrough, a second receptacle portion defining second receiving passageways therethrough, a barrier separating the first receptacle portion from the second receptacle portion and a pair of arms respectively laterally extending. A plurality of positioning apertures are defined from a top wall to a bottom wall of the housing in communication with corresponding receiving passageway. Positioning slots are defined between each receptacle portion and the barrier and between each receptacle portion and each side plate of the shell. The contacts are molded into the housing and include signal contacts and power contacts respectively received in the first and the second receiving passageways of the first and the second receptacle portions. All contacts are identical, each having a vertical section received in a distal end of a corresponding receiving passageway and extending upwardly into the corresponding positioning aperture, and a horizontal section received in the receiving passageway and having a solder tail exposed out of the housing. The shell encloses the housing and has a locking aperture on a bottom plate thereof under each positioning slot of the housing.

Other objects, advantages and novel features of the invention will become more apparent from the following detailed description of the present embodiment when taken in conjunction with the accompanying drawings.

BRIEF DESCRIPTION OF THE DRAWINGS

FIG. 3 is a front view of the connector of FIG. 1;

FIG. 4 is a rear view of the connector of FIG. 1;

DETAILED DESCRIPTION OF THE INVENTION

Figure 1:
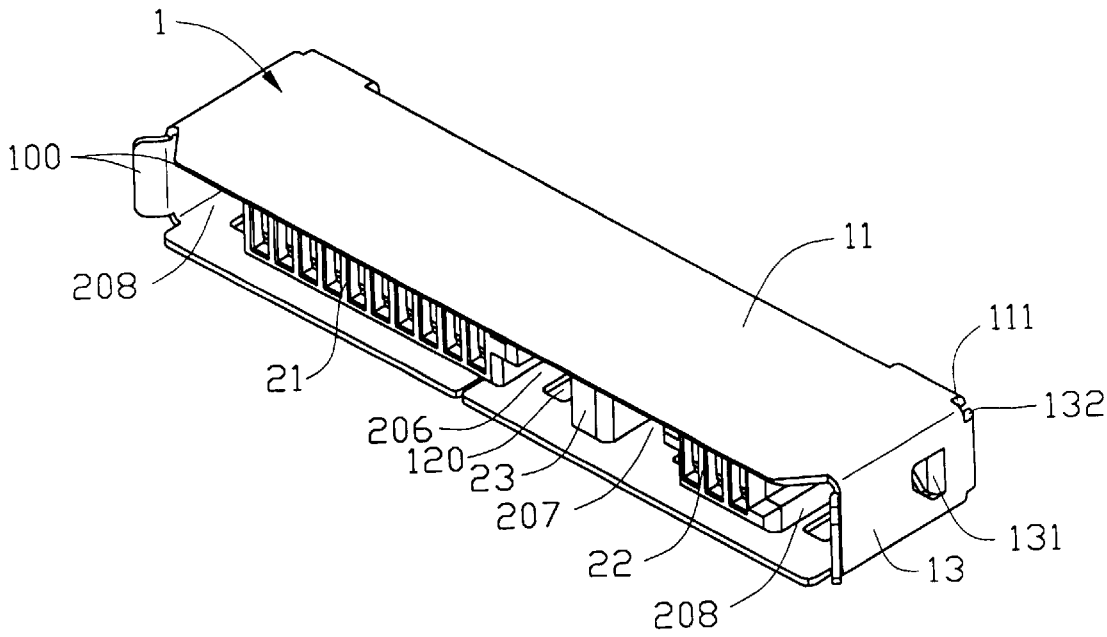
FIG. 1 is a perspective view of a mobile phone connector in accordance with the present invention.
Figure 2:
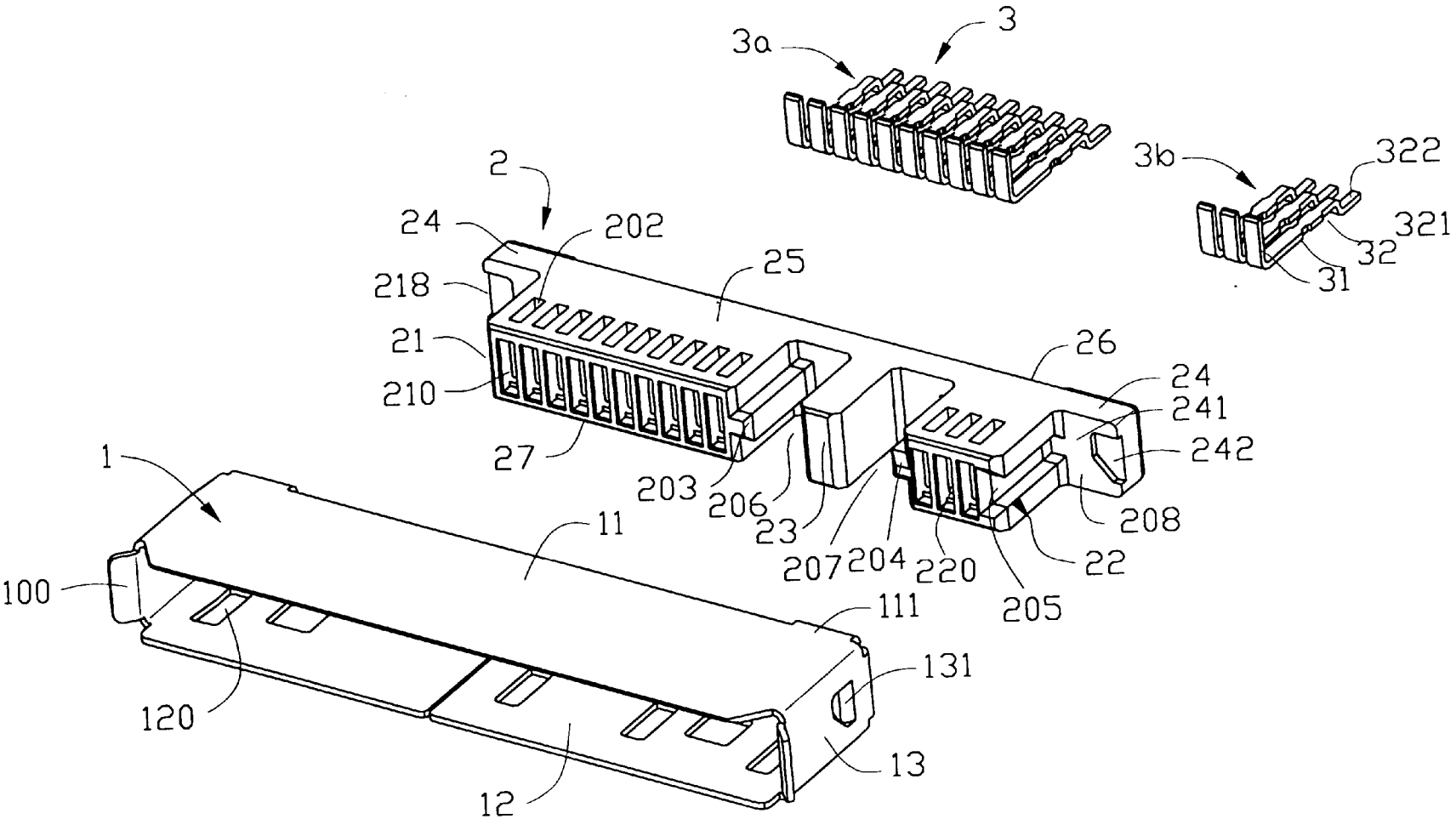
FIG. 2 is an exploded view of the mobile phone connector of FIG. 1.

Referring to FIGS. 1–2, a mobile phone connector in accordance with the present invention comprises a shell 1, an insulative housing 2 and a plurality of contacts 3 which include signal contacts 3*a* and power contacts 3*b*. The signal contacts 3*a* and the DC contacts 3*b* are identical for facilitating manufacture. Each contact 3*a* or 3*b* comprises a vertical section 31 and a horizontal section 32 having barbs 321 on a central portion for interferentially engaging with the housing 2. The horizontal section 32 forms a solder tail 322 on a distal end thereof slightly downwardly inclining and then extending horizontally for soldering to a printed circuit board (not shown).

The elongate housing 2 comprises a first receptacle portion 21, a second receptacle portion 22, a rectangular barrier 23 separating the first receptacle portion 21 from the second receptacle portion 22, and two opposite arms 24. The first receptacle portion 21 and the second receptacle portion 22 respectively define first receiving passageways 210 therethrough for receiving the contacts 3*a* and second receiving passageways 220 for receiving contacts 3*b*. In the present invention, the first receptacle portion 21 receives seven signal contacts 3*a* and the second receptacle portion 22 receives three DC power contacts 3*b*. Each receiving passageway defined a mating portion 200 (in FIG. 6) at a front end thereof. The housing 2 defines a plurality of positioning apertures 202 form a top wall 25 to a bottom wall 27 thereof in communication with corresponding receiving passageways 210, 220. Positioning slots 206, 207 are defined between the barrier 23 and each receptacle portion 21, 22. A protrusion 203 is formed on a right side of the first receptacle portion 21 extending into the positioning slot 206 for correct insertion of a signal plug (not shown). The second receptacle portion 22 forms a protrusion 204 on a left side thereof extending into the positioning slot 207 and defines a recess 205 in a right side thereof for correct insertion of a DC power plug (not shown). Each arm 24 laterally extends from the adjacent receptacle portion 21, 22 and defines a recess 242 on a front face 241 thereof.

The shell 1 has a shape and size suitable for enclosing the housing 2 and has a top plate 11, a bottom plate 12 and two opposite side plates 13. The shell 1 forms an array of flanges 100 for aiding insertion of mating plugs (not shown). In assembly, positioning slots 208 are defined between each receptacle portion 21, 22 and each side plate 13 of the shell 1 for receiving the plugs (not shown). A locking aperture 120 is defined in the bottom plate 12 under each position slot 206–208 for fixing the plugs (not shown). A locking tab 131 is formed on each side plate 13 extending inwardly into the recess 242 of the housing 2 for preventing outward movement of the housing 2. Retaining tabs 111 are formed on opposite rear sides of the top plate 11 and retaining tabs 132 are formed on a rear distal end of each side plate. During assembly the retaining tabs 111, 132 are bent and abut against a rear face 26 of the housing 2 for fixing the housing 2 in the shell 1.

Figure 5:
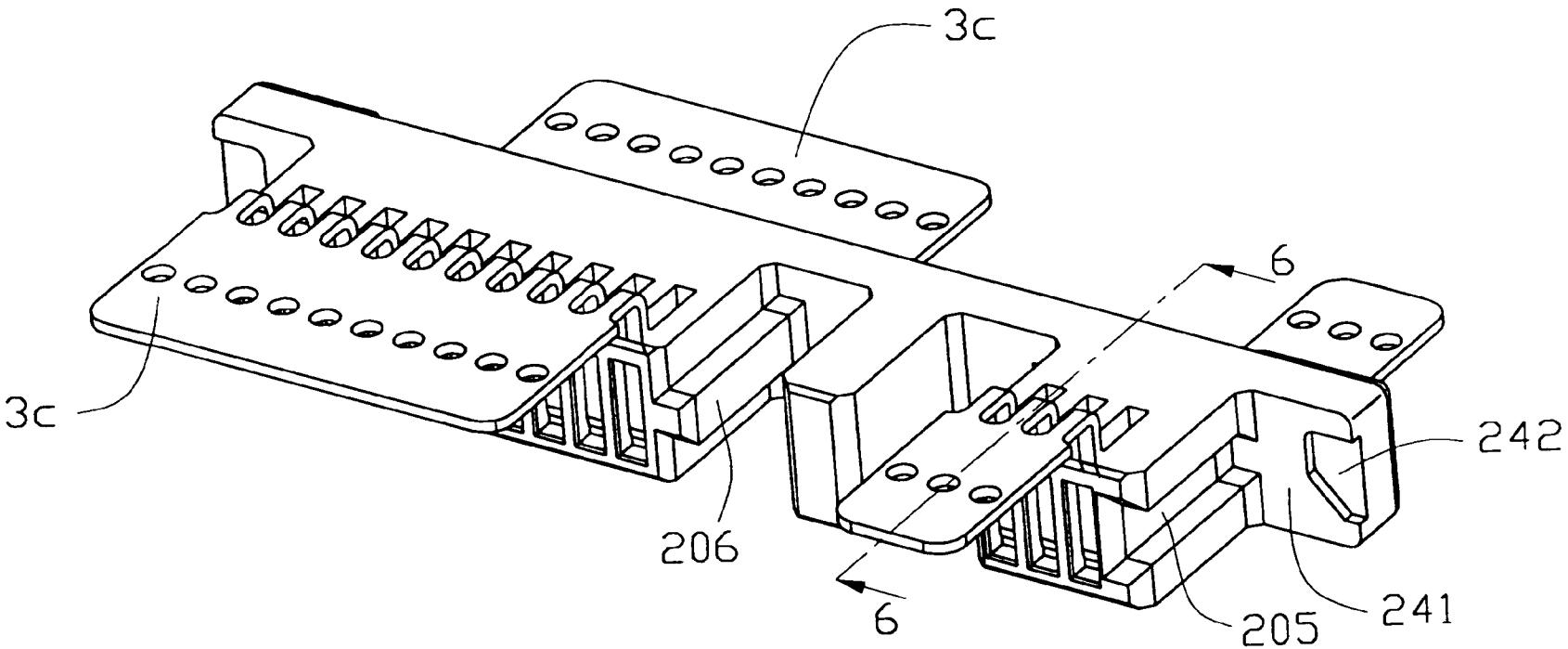
FIG. 5 is an assembled view of housing and contact strips.
Figure 6:
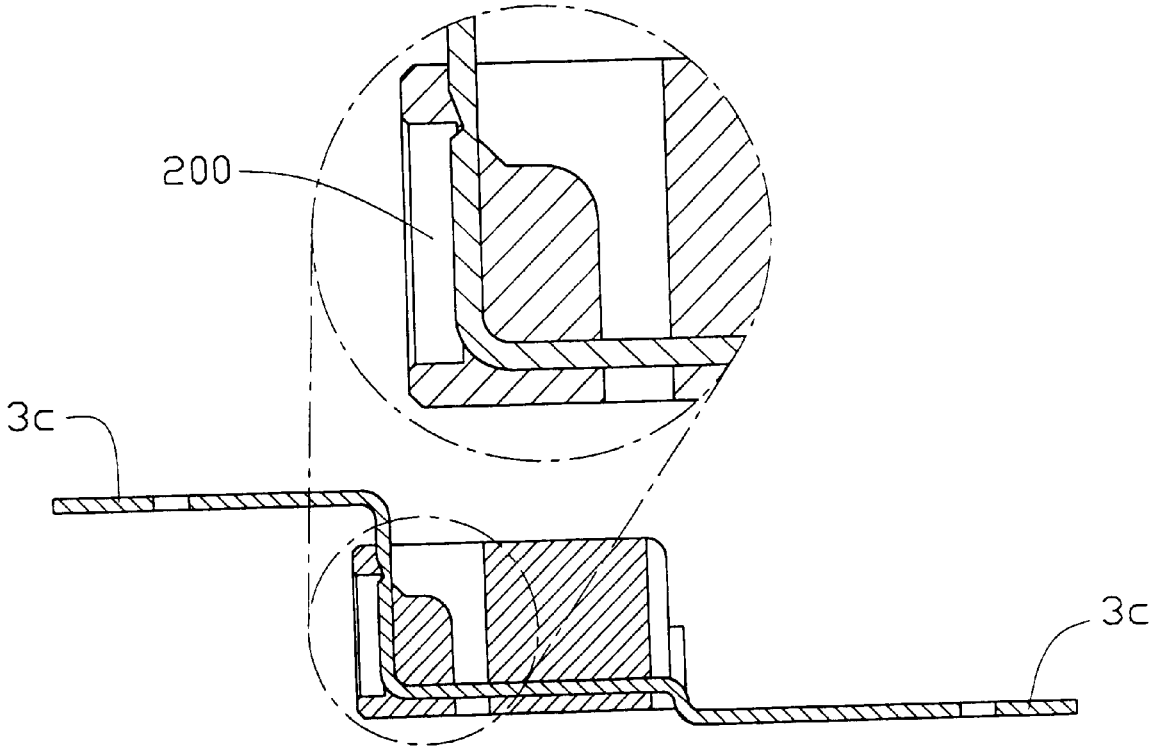
FIG. 6 is a sectional view take along line of 6—6 of FIG. 5.
Figure 7:
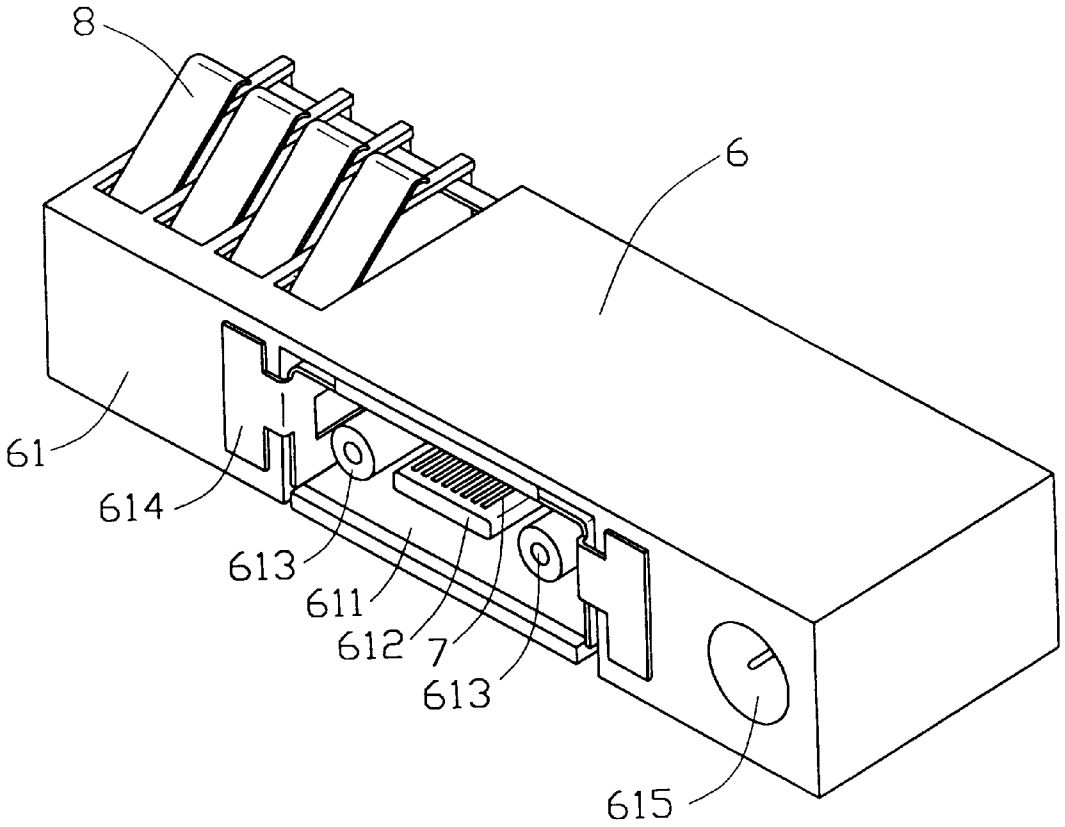
FIG. 7 (PRIOR ART)
FIG. 7 is a perspective view of a connector of the prior art.

Overall dimensions of a mobile phone are largely dependent on the dimension of the pitch distance between neighboring contacts, so the dimension of the pitch distance between neighboring contacts should be as small as possible. During assembly, when the contacts 3 are loaded into the receiving passageways 210, 220 of the housing 2, the housing 2 is easily damaged. To prevent this damage, the contacts 3 are molded into the receiving passageways 210, 220 of the housing 2. The mold (not shown) is easily manufactured and includes an upper mold and a lower mold. FIGS. 5–6 show an assembled view of the housing 2 and the contacts 3 with carrier strips 3*c* after insert molding. In an insert molding procedure, the contacts 3 are securely positioned within the molds, thereby preventing their displacement during high pressure injection of molten plastic resin into the mold cavity. The solder tails and the carrier strips 3*c* remain exposed to assure precise positioning. The carrier strips 3*c* are easily separated from the contacts after molding because of V-shaped cutouts at the junction of each contact and carrier strip. The horizontal sections 32 of the contacts 3 are embedded in the receiving slots 210, 220 of the housing 2 with the solder tails 332 exposed out of the housing for soldering on a printed circuit board. The vertical sections 31 are exposed to the mating portion 200 of the receiving passageways 210, 220 and extend upwardly into the positioning apertures 202 of the housing 2. The horizontal section accessible from the top wall and the bottom wall of the insulative housing through the positioning aperture.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing comprising a first receptacle portion defining first receiving passageways therethrough, a second receptacle portion defining second receiving passageways therethrough and a barrier separating the first receptacle portion from the second receptacle portion, each receiving passageway defining a mating portion at a front end thereof, a plurality of positioning apertures being defined from a top wall to a bottom wall of the housing in communication with corresponding receiving passageways, a pair of positioning slots being defined beside each receptacle portion;

a plurality of contacts being insert molded into the housing and including signal contacts and power contacts respectively received in the first and the second receiving passageways of the first and the second receptacle portions, each contact having a vertical section exposed in the mating portion of the receiving passageway, and a horizontal section accessible from the top wall and the bottom wall of the insulative housing through the positioning aperture; and a shell enclosing the housing.

2. The electrical connector as claimed in claim 1, wherein a protrusion is formed on a right side of the first receptacle portion.

3. The electrical connector as claimed in claim 1, wherein a protrusion is formed a left side and a slot is defined in a right side of the second receptacle portion.

4. The electrical connector as claimed in claim 1, wherein the positioning slots are defined between each receptacle portion and the barrier and between each receptacle portion and each of two side plates of the shell.

5. The electrical connector as claimed in claim 4, wherein the shell defines a plurality of locking apertures on a bottom plate thereof and aligned with the positioning slots.

6. The electrical connector as claimed in claim 1, wherein the housing comprises a pair of arms each laterally extending from one of two sides thereof and defining a recess in a front face thereof, and wherein the shell forms a locking tab on each of two side plates thereof extending inwardly into the recess.

7. The electrical connector as claimed in claim 1, wherein retaining tabs are respectively formed at a rear end of a top plate and a side plate of the shell and abut against a rear face of the housing.

8. The electrical connector as claimed in claim 1, wherein a distal end of the vertical section of each contact terminates near a boundary of the positioning aperture and the mating portion of the receiving passageway.

9. An electrical connector comprising:

an insulative housing comprising a first receptacle portion defining a plurality of first receiving passageways therein, a second receptacle portion defining a plurality of second receiving passageways therein, and a barrier separating the first receptacle portion and the second receptacle portion from each other, a pair of positioning slots positioned on two sides of each of said first and second receptacle portions, a protrusion formed in the positioning slot which is adjacent to the barrier;

a plurality of contacts disposed in the first receptacle portion and the second receptacle portion, respectively; and a shell enclosing the housing; wherein a top plate and a bottom plate respectively abut against a top wall and a bottom wall of the housing.

10. The connector as claimed in claim 9, wherein a plurality of positioning apertures are defined from the top wall to the bottom wall and in communication with the corresponding passageways, respectively, for facilitating severing a carrier strip of the contact therefrom.

* * * * *